US011843166B2

(12) United States Patent
Grando et al.

(10) Patent No.: US 11,843,166 B2
(45) Date of Patent: Dec. 12, 2023

(54) ANTENNA ASSEMBLIES AND ANTENNA SYSTEMS

(71) Applicant: Battelle Memorial Institute, Richland, WA (US)

(72) Inventors: Maurio B. Grando, Richland, WA (US); A. Mark Jones, West Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 0 days.

(21) Appl. No.: 17/117,005

(22) Filed: Dec. 9, 2020

(65) Prior Publication Data

US 2022/0181771 A1 Jun. 9, 2022

(51) Int. Cl.

| | |
|---|---|
| ***H01Q 1/38*** | (2006.01) |
| ***H01Q 1/48*** | (2006.01) |
| ***H01Q 21/00*** | (2006.01) |
| ***H01Q 21/06*** | (2006.01) |

(52) U.S. Cl.

CPC ..... *H01Q 1/38* (2013.01); *H01Q 1/48* (2013.01); *H01Q 21/0006* (2013.01); *H01Q 21/061* (2013.01)

(58) Field of Classification Search

CPC ..... H01Q 1/28; H01Q 3/34; H01Q 3/247; H01Q 3/2647; H01Q 5/307; H01Q 9/28; H01Q 21/065

See application file for complete search history.

(56) References Cited

U.S. PATENT DOCUMENTS

| | | | | |
|---|---|---|---|---|
| 4,085,406 | A | 4/1978 | Schmidt et al. | |
| 5,170,175 | A | 12/1992 | Kobus et al. | |
| 5,191,351 | A | 3/1993 | Hofer et al. | |
| 5,815,122 | A | 9/1998 | Nurnberger et al. | |
| 6,853,351 | B1 | 2/2005 | Mohuchy et al. | |
| 7,791,552 | B1 * | 9/2010 | Romanofsky ..... | H01Q 3/46 343/754 |

(Continued)

FOREIGN PATENT DOCUMENTS

| | | |
|---|---|---|
| FR | 3017493 | 8/2015 |
| GB | 1572671 | 7/1980 |
| WO | WO 2020/169619 | 8/2020 |

OTHER PUBLICATIONS

WO PCT/US2021/048618 Search Rept., Dec. 20, 2021, Battelle Memorial Institute.

(Continued)

*Primary Examiner* — Tung X Le

(74) *Attorney, Agent, or Firm* — Wells St. John P.S.

(57) ABSTRACT

Antenna assemblies and antenna systems are described. According to one aspect, a printed circuit board antenna system includes a dielectric substrate comprising first and second surfaces that are opposite to one another, first electrically conductive material of an antenna element adjacent to the first surface of the dielectric substrate, wherein the antenna element is configured to emit electromagnetic energy, and second electrically conductive material of a ground plane adjacent to the second surface of the dielectric substrate, wherein the ground plane is aligned with the antenna element and configured to reflect some of the electromagnetic energy in a direction towards the antenna element.

45 Claims, 7 Drawing Sheets

(56) References Cited

U.S. PATENT DOCUMENTS

| | | | | |
|---|---|---|---|---|
| 11,769,954 | B2 * | 9/2023 | Cheng | H01Q 9/065 343/848 |
| 2009/0284415 | A1 * | 11/2009 | Worl | H01Q 21/0025 342/372 |
| 2014/0218258 | A1 * | 8/2014 | Walker | H01Q 1/007 343/848 |
| 2019/0267711 | A1 * | 8/2019 | O'Brien | H01Q 15/006 |
| 2019/0334255 | A1 * | 10/2019 | Howarth | H01Q 21/0025 |
| 2020/0194887 | A1 * | 6/2020 | Necsoiu | G01S 13/9023 |
| 2022/0021123 | A1 * | 1/2022 | Koul | H01Q 15/0086 |

OTHER PUBLICATIONS

WO PCT/US2021/048618 Writ. Opin., Dec. 20, 2021, Battelle Memorial Institute.

Jones et al., "Wideband Archimedean Spiral Antenna for Millimeter-Wave Imaging Array", IEEE International Symposium on Antennas and Propagation USNC/URSI National Radio Science Meeting, 2017, United States, pp. 845-846.

Koul et al., U.S. Appl. No. 63/053,058, filed Jul. 17, 2020, titled "Broadband Metamaterial Enabled Electromagnetic Absorbers and Polarization Converters", 37 pages.

Kulkarni et al., "An X-Band Circularly Polarized Substrate Integrated Waveguide Slot Antenna", IEEE International Symposium on Antennas and Propagation, Jun. 26, 2016, United States, pp. 1811-1812.

Sakomura et al., "Compact Planar Two-Arm Compound Spiral Antenna for L-/X-Band Direction Finding Applications", IEEE International Symposium on Antennas and Propagation USNC/URSI National Radio Science Meeting, 2018, United States, pp. 853-854.

Wangler, "RF Linear Accelerators", Second Edition, Chapter 1 Sections 1.12-1.14, Wiley, 2008, Germany, pp. 24-27.

* cited by examiner

ANTENNA ASSEMBLIES AND ANTENNA SYSTEMS

STATEMENT AS TO RIGHTS TO INVENTIONS MADE UNDER FEDERALLY-SPONSORED RESEARCH AND DEVELOPMENT

This invention was made with Government support under Contract DE-AC05-76RL01830 awarded by the U.S. Department of Energy. The Government has certain rights in the invention.

TECHNICAL FIELD

This disclosure relates to antenna assemblies and antenna systems.

BACKGROUND OF THE DISCLOSURE

Electromagnetic systems are utilized for numerous applications, including wireless communications, remote sensing, and security screening in but a few illustrative examples. Different arrangements for emitting and receiving the electromagnetic waves may be used and tailored to the different applications of use of the electromagnetic systems. More specifically, different designs of antennas for emitting and receiving the electromagnetic energy may be utilized corresponding to the requirements of the different applications of use.

A spiral antenna is one example of an antenna that may be utilized to emit and receive electromagnetic energy. Some conventional spiral antenna configurations utilize a separate cavity housing that includes absorber material to eliminate back lobe radiation from the antenna. The use of the separate cavity increases the size of the electromagnetic energy emission and reception system.

At least some aspects of the present disclosure are directed towards antennas, antenna systems, antenna arrays, and methods of fabrication.

BRIEF DESCRIPTION OF THE DRAWINGS

Example embodiments of the disclosure are described below with reference to the following accompanying drawings.

DETAILED DESCRIPTION OF THE DISCLOSURE

This disclosure is submitted in furtherance of the constitutional purposes of the U.S. Patent Laws "to promote the progress of science and useful arts" (Article 1, Section 8).

Figure 1:
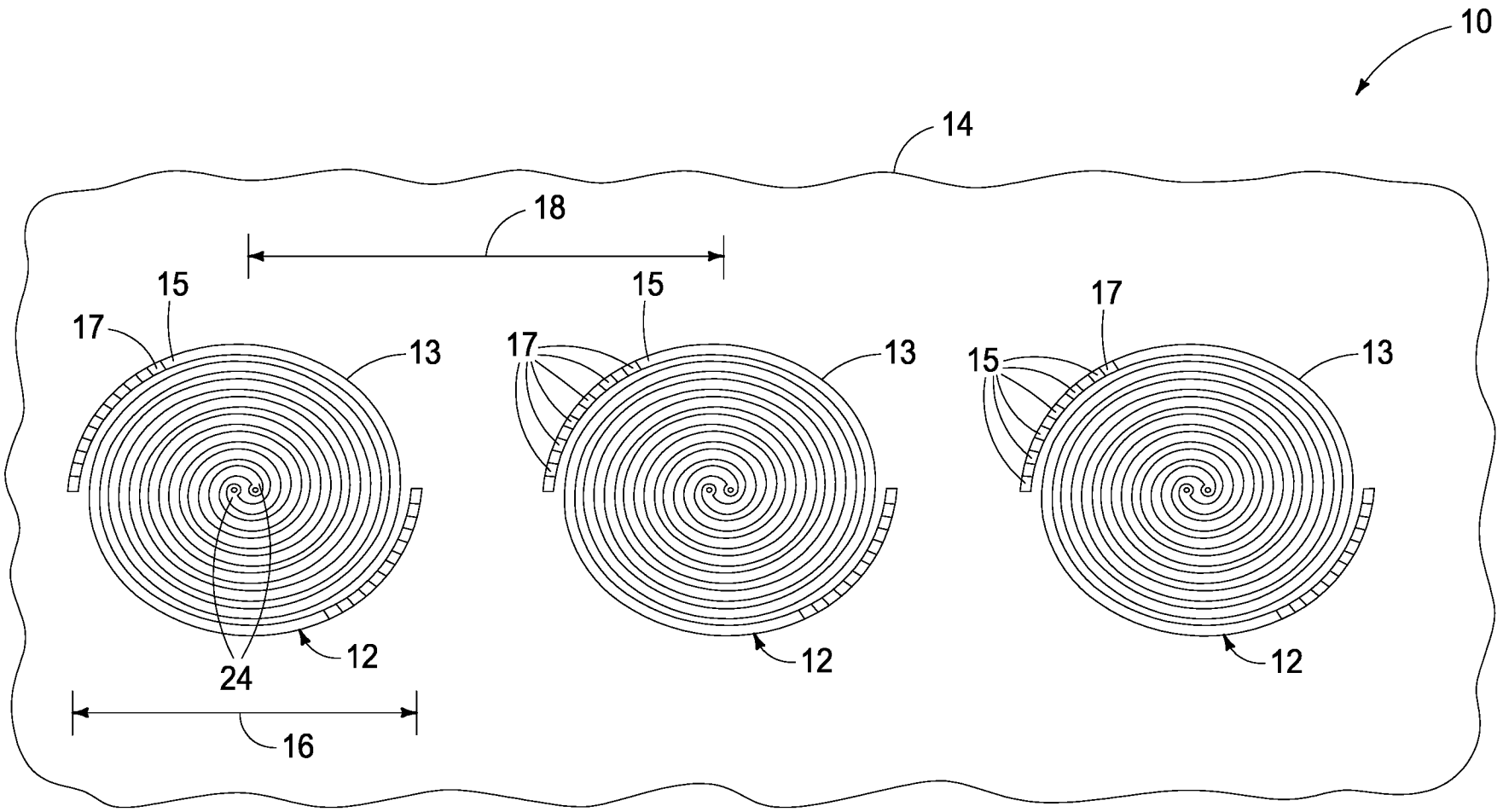
FIG. 1 is a plan view of an antenna system according to one embodiment.

Referring to FIG. 1, an antenna system 10 is shown according to one embodiment of the disclosure. The illustrated antenna system 10 is in the form of an antenna array and comprises a plurality of antenna assemblies 12 having the same configuration and are individually configured to emit and receive electromagnetic energy or waves. The antenna system 10 includes a substrate 14 to support the antenna assemblies 12. In some example embodiments described below, the substrate 14 is a printed circuit board (PCB) stackup comprising a plurality of different PCB layers of dielectric material, conductive traces and conductive vias to form components of the antenna assemblies 12.

The illustrated antenna assemblies 12 individually include an antenna element 13 as shown and a ground plane and signal lines (the ground plane and signal lines are directly below the antenna element 13 in some embodiments and are shown and discussed with respect to the examples of FIGS. 3-4).

The antenna elements 13 are configured to emit and receive electromagnetic energy. Each of the antenna elements 13 are formed of electrically conductive material 15, such as ½ oz. copper, in one implementation. In the depicted embodiment, the antenna elements 13 are each a differential fed, dual arm 24, Archimedean spiral antenna that has relatively small size allowing integration into a wideband array. This example of antenna element 13 produces circular polarization over a wide beamwidth and a wide bandwidth.

For example, the antenna assemblies 12 shown in FIG. 1 are configured to emit and receive electromagnetic waves within a frequency range of 10-40 GHz in one embodiment but can be scaled to other sizes for use in other frequency bands. The antenna assemblies 12 of the depicted array individually have a diameter 16 of approximately 15 mm and antenna assemblies are spaced apart by a pitch 18 of approximately 19 mm in one embodiment. This example antenna has a percent bandwidth of 120 (i.e., absolute bandwidth 30 GHz/center frequency 25 GHz) and a 120 degree-beam width at the lower end of the 10-40 GHz frequency band.

Figure 2:
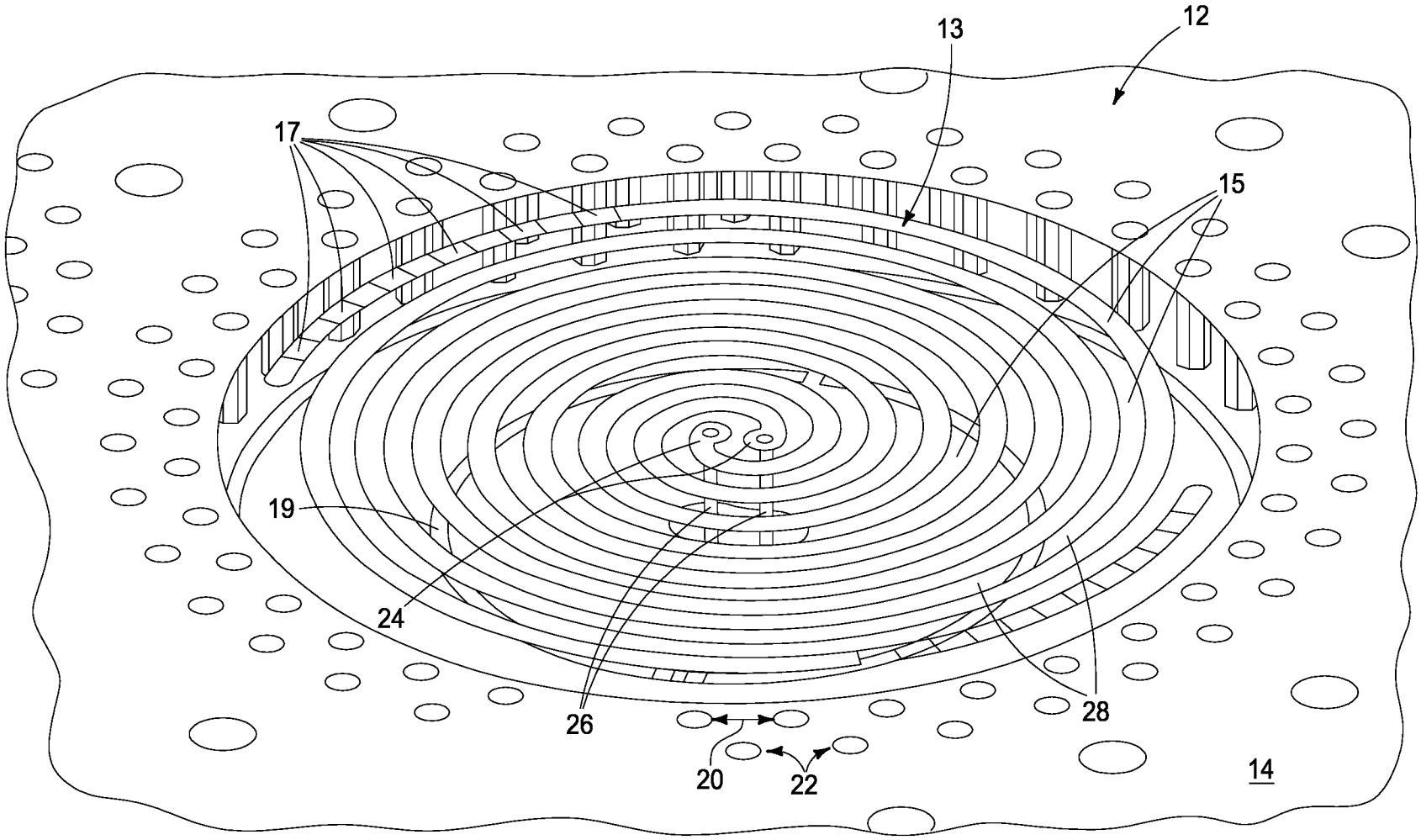
FIG. 2 is an isometric view of an antenna assembly according to one embodiment.

Referring to FIG. 2, additional features of an antenna assembly 12 are shown according to one embodiment. In some embodiments, the substrate 14 is solid and void of free space beneath the antenna element 13 (e.g., substrate 14 is implemented as a PCB stackup in the embodiment shown in FIG. 4). A portion of the substrate 14 of the antenna assembly 12 has been removed in FIG. 2 beneath antenna element 13 to show a plurality of conductive feed vias 26 and a conductive ground plane 28 that are discussed further below.

In some embodiments, a plurality of vias 20, 22 are provided about perimeters of the antenna element 13 and the ground plane 28. The vias 20, 22 extend between opposing upper and lower surfaces of the antenna assembly 12. Vias 20, 22 may be referred to as ground stitching or fencing vias, individually have a diameter of 20 mils, and be backfilled with electrically conductive material 15 between the top layer 30 and bottom layer 34. In one embodiment, the conductive vias 20, 22 are formed in a plurality of rings that define a cylindrical cavity about the spiral arms 24 of antenna assembly 12. In one embodiment, each antenna assembly 12 is within a respective PCB via cavity defined by rings of vias 20, 22 to reduce or prevent mutual coupling of the individual antenna assembly 12 with adjacent antenna assemblies 12 in an array system 10.

The arms 24 of antenna element 13 comprise electrically conductive material 15 in the depicted embodiment. In some embodiments, some portions of the arms 24 have increased electrical resistance compared with other portions of the arms 24 comprising electrically conductive material 15. For example, in the depicted embodiment, arms 24 are end-loaded with a plurality of surface mount resistors 17 that are coupled with electrically conductive material 15 of the arms 24 to suppress re-radiation from edges of arms 24. In one embodiment, the resistances of the resistors 17 in the spiral arms 24 increase from a first location of each respective arm 24 outwardly therefrom towards the respective distal ends of arms 24 and include resistances of 10 Ohms, 25 Ohms, 25 Ohms, 50 Ohms, 50 Ohms, and 50 Ohms, respectively.

The described example embodiment including a spiral antenna element in combination with an electrically conducting ground plane 28 within a PCB stackup substrate 14 provides unidirectional emission and reception (i.e., outwardly from the antenna assembly 12 with respect to the top layer 30 including antenna element 13). The use of ground plane 28 in some embodiments eliminates the need for a separate cavity backing structure that is typically utilized to provide unidirectional operation of the antenna assembly 12.

Ground plane 28 is configured to reflect electromagnetic energy that was emitted in a downward direction from antenna element 13 in FIG. 2 (or electromagnetic energy received from externally of the antenna system 10 in a downward direction) in a direction upwardly back towards the antenna element 13. Ground plane 28 configures the antenna assembly 12 to be unidirectional according to some embodiments of the disclosure that emits electromagnetic energy outwardly of antenna assembly 12 in a single direction upwards in FIG. 2 and away from the antenna assembly 12 and receives electromagnetic energy travelling in a downward direction with respect to antenna assembly 12 of FIG. 2.

Figure 3:
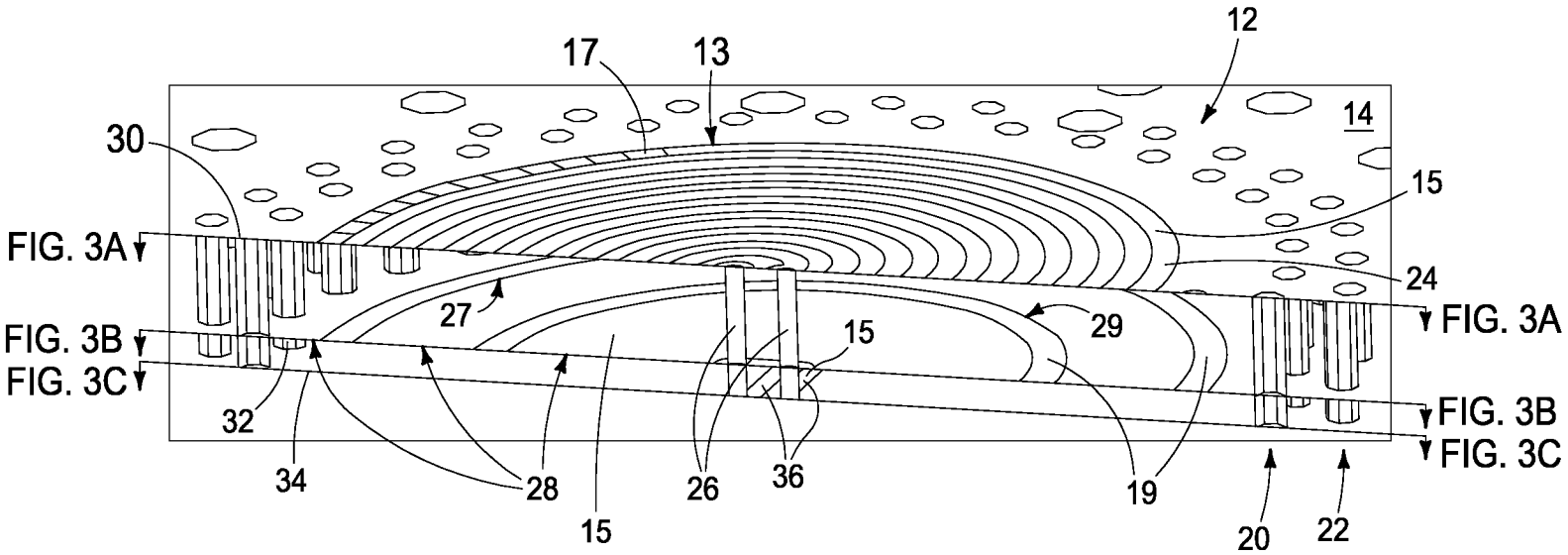
FIG. 3 is a cross-sectional isometric view of an antenna assembly according to one embodiment.
Figure 3A:
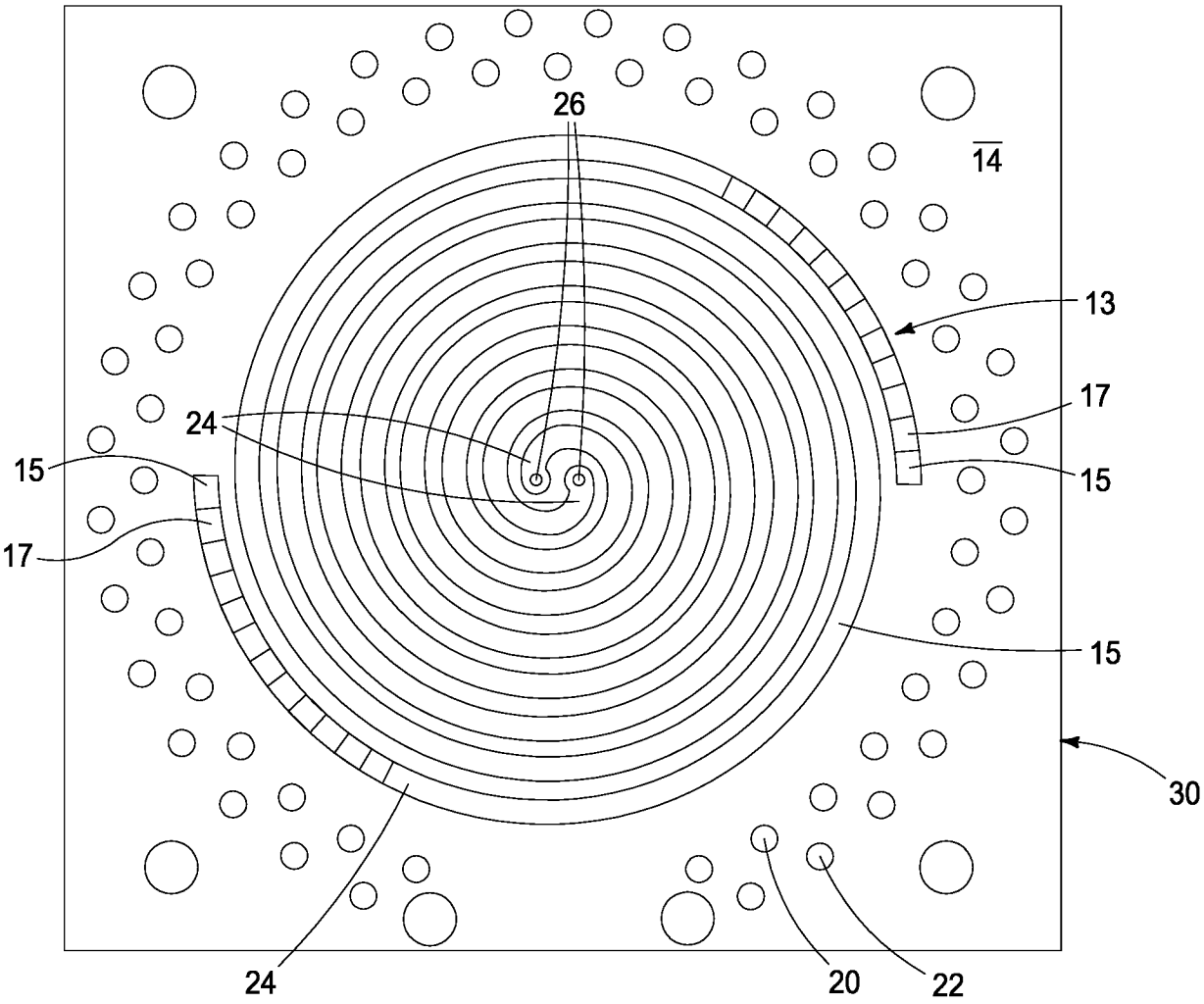
FIG. 3A is a plan view of an antenna layer of an antenna assembly according to one embodiment.
Figure 3B:
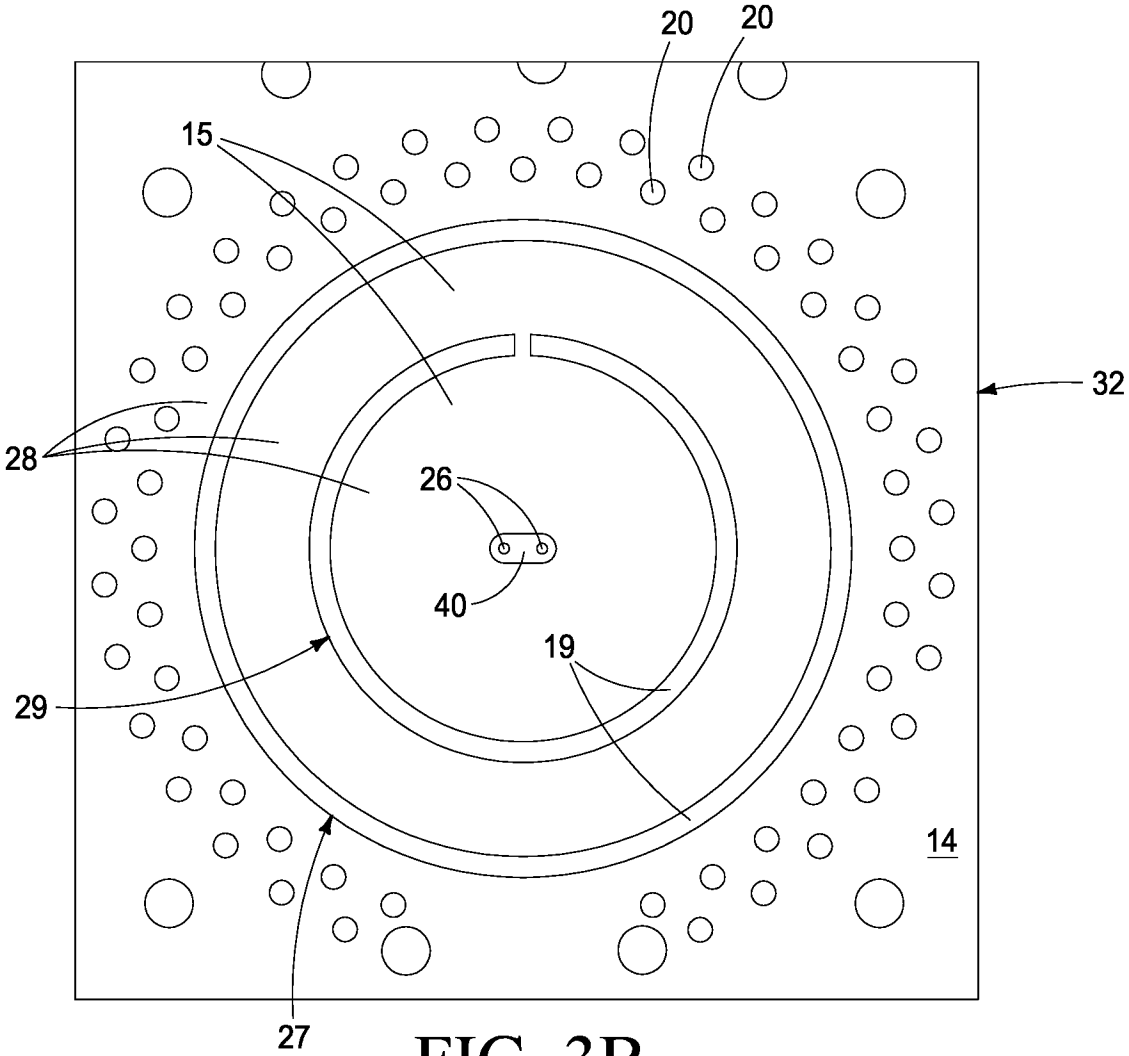
FIG. 3B is a plan view of a ground layer of an antenna assembly according to one embodiment.
Figure 3C:
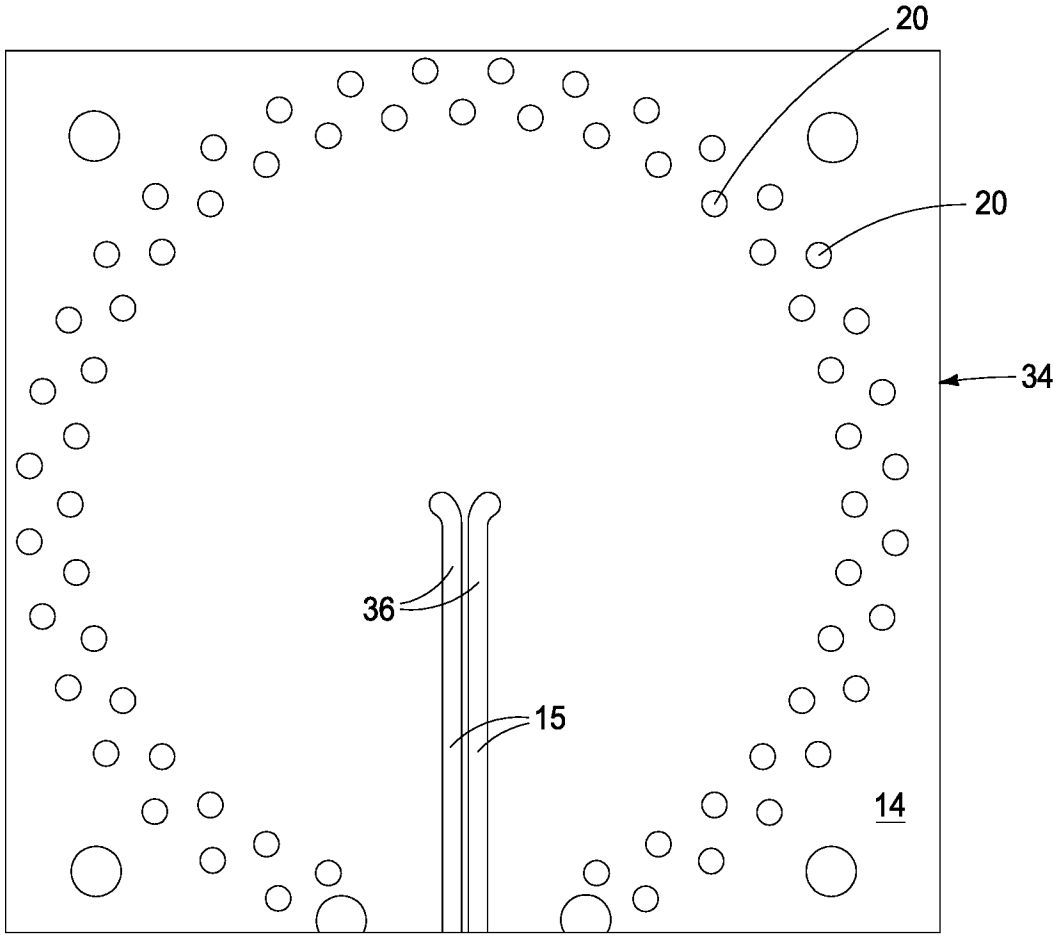
FIG. 3C is a plan view of a signal layer of an antenna assembly according to one embodiment.

Referring to FIG. 3 and FIGS. 3A-3C, a plurality of layers 30, 32, 34 of the substrate 14 are shown according to one embodiment. FIG. 3 is similar to FIG. 2 where dielectric material of the substrate 14 beneath antenna element 13 has been removed to illustrate details of layers 30, 32, 34. FIGS. 3A, 3B and 3C are plan views of the respective layers 30, 32, 34.

A top layer 30 includes conductive material 15 and resistive material 17 of antenna element 13. A ground layer 32 includes conductive material 15 of a ground plane 28 and resistive material 19 having increased electrical resistivity compared with conductive material 15. In one embodiment, resistive material 19 has an electrical resistance within a range of 100-500 Ohms/square with higher electrical resistance being desired. The resistive material is OhmegaPly® available from Ohmega Technologies, Inc., in one embodiment. A bottom or signal layer 34 includes conductive material 15 of a plurality of transmission lines 36 adjacent a lower surface of substrate 14.

In the illustrated embodiment, ground plane 28 includes conductive material 15 in the shape of a circle having a perimeter. Ground plane 28 is aligned with and positioned directedly below antenna element 13 in the illustrated embodiment. As mentioned above, the rings of conductive vias 20, 22, antenna element 13 and ground plane 28 define a via cavity of the antenna assembly 12 and the antenna element 13 and ground plane 28 are aligned with one another at opposing ends of the via cavity. In some embodiments described herein, the antenna element 13 and ground plane 28 are fabricated using PCB materials and PCB processes where the antenna element 13 and ground plane 28 are formed in respective planes that are parallel to one another.

Resistive material 19 is embedded within the circular perimeter of the ground plane 28 at specific pre-determined locations to absorb, suppress or reduce undesired cavity field modes that result from the geometry of the via cavity and the emission of certain frequencies of electromagnetic energy from antenna element 13 towards the ground plane 28. The locations of the resistive material 19 for suppressing the modes correspond to locations where maximums of the modes occur for the given via cavity of the antenna assembly 12 and frequencies of electromagnetic energy emitted. The geometry or dimensions of the cylindrical via cavity defined by the antenna element 13, ground plane 28 and vias 20, 22 define where the maximums of the field modes occur.

In one embodiment, modeling software, such as ANSYS HFSS 3D electromagnetic (EM) simulation software, is used to model the PCB design and determine the locations where maximum energy of the field modes occur within the perimeter of ground plane 28 and to embed the resistive material 19 at the determined locations of the maximum energy. Various parameters for a given design of antenna assembly 12 are entered into the modeling software being used and include, for example, the geometry and dimensions of the via cavity, frequency range, dielectric constant of the substrate, and electrical conductivity of the conductive material 15. The modeling software determines the locations within the perimeter of the ground plane 28 where the generated field modes have maximum energy for placement of the resistive material 19.

Alternatively, closed form equations may be used to determine the locations where the maximums of the field modes occur on the ground plane 28 for a given via cavity design and frequency range. Field solutions of a cylindrical cavity of length L and radius R follow from solutions of a cylindrical waveguide. The resonance frequencies are different transverse electric (TE) modes and transverse magnetic (TM) modes according to:

$$f_{mnp} = \frac{2}{2\pi\sqrt{\mu_r\epsilon_r}}\sqrt{\left(\frac{X_{mn}}{r}\right)^2 + \left(\frac{p\pi}{L}\right)^2} \quad \text{Equation 1}$$

$$f_{mnp} = \frac{c}{2\pi\sqrt{\mu_r\epsilon_r}}\sqrt{\left(\frac{X'_{mn}}{R}\right)^2 + \left(\frac{p\pi}{L}\right)^2} \quad \text{Equation 2}$$

where $X_{mn}$ denotes the n-th zero of the m-th Bessel function, and $X'_{mn}$ denotes the n-th zero of the derivative of the m-th Bessel function. Additional details are discussed in T. Wangler, *RF linear accelerators*, Wiley (2008), the teachings of which are incorporated herein by reference.

Cylindrical field modes are formed by the cylindrical via cavity of the described example antenna assembly 12 and resistive material 19 in the shape of plural concentric rings 27, 29 is embedded within the perimeter of the ground plane 28 beneath the antenna element 13 to reduce the resultant cavity field modes. In particular, modelling of the illustrated example antenna assembly 12 indicated that the generated field mode occurred at a single narrow bandwidth of 30 GHz at the locations of the concentric rings 27, 29 shown in FIG. 3B. Other designs or dimensions of antenna assemblies 12 may result in field modes being generated at a plurality of different narrowband frequencies and resistive material 19 may be embedded at other appropriate locations of the ground plane in such other antenna assemblies to reduce the generated field modes. The use of resistive material 19 in ground plane 28 to suppress generated field modes increases performance of the antenna assembly 12 over wide frequency bands utilized in some implementations of the antenna assembly 12 and that may be otherwise limited if the field modes were not suppressed.

More specifically, mode suppression allows for broadband gain, antenna pattern coverage (beamwidth), and polarization to be unimpeded over the 120% bandwidth. If the cavity modes were not suppressed, there would be frequency bands within the 120% bandwidth centered around the TE/TM modes described in the equations above that would be unusable. In addition, the gain would be lower and the polarization would not be circular.

Feed vias 26 include conductive material between respective arms 24 of antenna element 13 and respective transmission lines 36. Feed vias 26 each have a diameter of 10 mils in one embodiment. Transmission lines 36 are differential microstrip transmission lines that are configured to conduct electrical signals with respect to antenna assembly 12 in one embodiment. Feed vias 26 and transmission lines 36 conduct electrical signals between antenna element 13 and external circuitry, such as a balun, switches, an amplifier and a transceiver (an example balun 50 is shown in FIG. 4).

Figure 4:
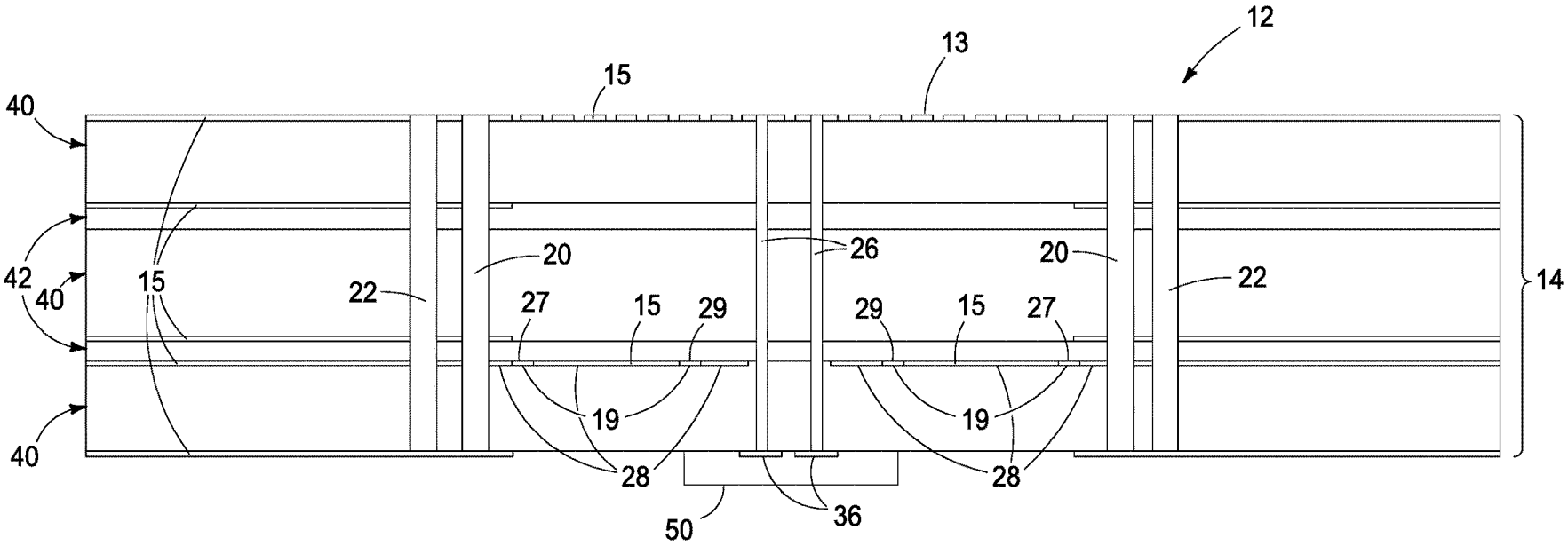
FIG. 4 is a cross-sectional view of an antenna assembly according to one embodiment.

Referring to FIG. 4, a cross-sectional view of an example antenna assembly 12 is shown according to one embodiment. The illustrated substrate 14 is a printed circuit board (PCB) stackup that mechanically supports and electrically connects electrical or electronic components using conductive tracks, pads and other features etched from one or more sheet layers of electrically conductive material 15 (e.g., copper) laminated onto and/or between sheet layers of non-conductive dielectric material 40, 42. In particular, the substrate 14 includes a plurality of layers 40 of dielectric material in the form of respective layers of PCB material and a plurality of layers 42 of dielectric material in the form of respective layers of PCB prepreg material in the described embodiment. The substrate 14 is substantially solid and void of free space between conductive material 15 of the antenna element 13 and conducive material 15 of ground plane 28 in the illustrated embodiment.

The upper two layers 40 and both layers 42 may be referred to herein as a first dielectric substrate. Electrically conductive material 15 of antenna element 13 is adjacent to a first or upper surface of the first dielectric substrate. Electrically conductive material 15 of the electrically conductive ground plane 28 is adjacent to a second or lower surface of the first dielectric substrate which is opposite to the first surface of the first dielectric substrate. The bottom layer 40 in FIG. 4 may be referred to as a second dielectric substrate and electrically conductive transmission lines 36 are adjacent to a lower surface of the bottom layer 40.

A plurality of antenna assemblies 12 of an array may be fabricated upon a single substrate 14 in some embodiments. In one example, the layers 40, 42 of the substrate 14 are continuous and may be used to support and fabricate the antenna assemblies 12 of the array using a single PCB stackup.

In one embodiment, it is desired that the PCB material and PCB prepreg material each have a dielectric constant of 3.3 or less. Some examples of PCB material that may be used for the layers of dielectric material 40 include Rogers RO3003 high frequency laminates available from Rogers Corporation. An example of prepreg PCB material that may be used for layers 42 includes Rogers 3003 bondply.

In one embodiment, each of the layers of conductive material 15 are ½ oz. copper. The uppermost and bottom layers of dielectric material 40 each have a height thickness of approximately 20 mils and the middle layer of dielectric material 40 has a height thickness of approximately 30 mils. The layers 42 each have a height thickness of approximately 5 mils. In this embodiment, the spacing of the antenna element 13 and ground plane 28 is approximately 60 mils. Other layers of material, other types of material, and/or layers having different thicknesses may be used in other embodiments.

In one embodiment, the antenna system may also include one or more surface mount technology (SMT) components that may be attached to the antenna assemblies 12. In FIG. 4, an example SMT component in the form of a chip balun 50 is affixed to a lower surface of substrate 14 opposite to antenna element 13. Other SMT components, such as switches and amplifiers, may also be affixed to substrate 14 in other embodiments.

The arrangement shown in FIG. 4 is one illustrative example of antenna assembly 12 and substrate 14 that operates to emit and receive electromagnetic waves having frequencies within a range of 10-40 GHz. In other embodiments, different layers of dielectric materials having different thicknesses may be used to construct antenna assembly 12 for use in different applications and different frequency ranges.

As discussed herein, the entire antenna assembly 12 may be implemented using PCB materials and processes according to some embodiments. Standard PCB fabrication techniques may be utilized to form antenna systems, antenna arrays and antenna assemblies discussed herein. The antenna components are formed by etching conductive material and resistive material upon respective layers of dielectric material that are bonded together to form a PCB device comprising the antenna system in one embodiment. The use of a PCB design for some of the antenna assemblies provides a highly-integrated, inexpensive, automated manufacturing solution over a wide frequency band by allowing the feedlines and/or other RF/microwave components to be co-located directly behind the antenna aperture.

Some of the embodiments described above are well-suited for integrating feedlines or SMT components into the antenna assemblies and antenna systems, and including integration thereof into a single printed circuit board. RF switches for controlling which antenna assemblies of the array are utilized for signal transmission or reception and other components may be mounted on the same PCB that includes the antenna array. These example embodiments of the antenna assemblies may be fabricated in a single PCB fabrication effort allowing parts to be populated by pick-and-place machines thereby reducing the amount of labor in the construction of the antenna assemblies compared with other approaches. More specific example embodiments of the antenna assemblies described herein are low-profile, highly integrated, have circular-polarization, wide bandwidth, and wide beamwidth and may be compatible with various array designs and compatible with other integrated surface-mount components. Example applications of use of the antenna assemblies, arrays and systems disclosed herein include use in imaging systems for security screening (e.g., millimeter wave scanning systems), wideband communications (such as 5G systems), SATCOM radios, and remote sensing.

The provision of a ground plane spaced from the antenna element in some of the described embodiments eliminates the need for a separate absorbing cavity as is used in some conventional arrangements and allows fabrication of compact antenna assemblies having reduced size compared with the conventional antenna arrangements that use a separate absorbing cavity. Accordingly, the size of some of the antenna assemblies described herein is small to allow integration into a wideband array. In one embodiment, the height of the antenna assembly between the antenna assembly 13 and ground plane 28 is $0.22\lambda_{gc}$ wavelengths where the subscript g stands for guided (i.e. wavelength in the dielectric) and the subscript c stands for center frequency. Some of the antenna assemblies discussed herein provide performance comparable to larger conventional spiral antenna solutions while being an order of magnitude thinner.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended aspects appropriately interpreted in accordance with the doctrine of equivalents.

Further, aspects herein have been presented for guidance in construction and/or operation of illustrative embodiments of the disclosure. Applicant(s) hereof consider these described illustrative embodiments to also include, disclose and describe further inventive aspects in addition to those explicitly disclosed. For example, the additional inventive aspects may include less, more and/or alternative features than those described in the illustrative embodiments. In more specific examples, Applicants consider the disclosure to include, disclose and describe methods which include less, more and/or alternative steps than those methods explicitly disclosed as well as apparatus which includes less, more and/or alternative structure than the explicitly disclosed structure.

What is claimed is:

1. A printed circuit board antenna system comprising:

a printed circuit board stackup comprising a dielectric substrate that comprises first and second surfaces that are opposite to one another;

a first electrically conductive material of an antenna element adjacent to the first surface of the dielectric substrate, wherein the antenna element is configured to emit electromagnetic energy;

a second electrically conductive material of a ground plane adjacent to the second surface of the dielectric substrate, wherein the ground plane is aligned with the antenna element and configured to reflect some of the electromagnetic energy in a direction towards the antenna element; and a plurality of vias adjacent to and outside perimeters of the antenna element and the ground plane, and wherein the vias comprise a third electrically conductive material between the first and second surfaces of the dielectric substrate.

2. The system of claim 1 wherein the ground plane is positioned directly below the antenna element.

3. The system of claim 1 wherein the antenna element is configured to emit the electromagnetic energy within a frequency range of 10-40 GHz.

4. The system of claim 1 wherein the antenna system is unidirectional and the electromagnetic energy is emitted outwardly from the antenna system in a single direction away from the antenna system.

5. The system of claim 1 wherein the vias are provided in two rings.

6. The system of claim 1 wherein the dielectric substrate is solid and substantially void of free space between the antenna element and the ground plane.

7. The system of claim 1 wherein the first electrically conductive material is provided upon one printed circuit board layer of the printed circuit board stackup and the second electrically conductive material is provided upon another printed circuit board layer of the printed circuit board stackup.

8. The system of claim 1 wherein the dielectric substrate comprises a plurality of printed circuit board layers of dielectric material between the antenna element and the ground plane.

9. The system of claim 8 wherein the antenna element and the ground plane are provided upon different ones of the printed circuit board layers of the dielectric material.

10. The system of claim 1 wherein the dielectric substrate comprises a cavity between the first and second surfaces of the dielectric substrate, and wherein the cavity is aligned with the antenna element and the ground plane.

11. The system of claim 10 wherein the vias define the cavity.

12. The system of claim 1 wherein the vias are provided around substantially an entirety of the perimeter of the antenna and the perimeter of the ground plane.

13. A printed circuit board antenna system comprising:

a printed circuit board stackup comprising a dielectric substrate that comprises first and second surfaces that are opposite to one another;

a first electrically conductive material of an antenna element adjacent to the first surface of the dielectric substrate, wherein the antenna element is configured to emit electromagnetic energy;

a second electrically conductive material of a ground plane adjacent to the second surface of the dielectric substrate, wherein the ground plane is aligned with the antenna element and configured to reflect some of the electromagnetic energy in a direction towards the antenna element;

wherein the antenna element is a first antenna element and the ground plane is a first ground plane, and further comprising:

a plurality of additional antenna elements adjacent to the first surface of the dielectric substrate; and a plurality of additional ground planes adjacent to the second surface of the dielectric substrate.

14. The system of claim 13 wherein the dielectric substrate comprises at least one layer of continuous dielectric material.

15. The system of claim 13 further comprising a plurality of vias about a perimeter of each of the antenna elements and about a perimeter of each of the ground planes, and wherein the vias comprise electrically conductive material between the first and second surfaces of the dielectric substrate.

16. A printed circuit board antenna system comprising:

a printed circuit board stackup comprising a dielectric substrate that comprises first and second surfaces that are opposite to one another;

a first electrically conductive material of an antenna element adjacent to the first surface of the dielectric substrate, wherein the antenna element is configured to emit electromagnetic energy;

a second electrically conductive material of a ground plane adjacent to the second surface of the dielectric substrate, wherein the ground plane is aligned with the antenna element and configured to reflect some of the electromagnetic energy in a direction towards the antenna element; and wherein the ground plane has a perimeter, and further comprising resistive material within the perimeter of the ground plane, and wherein the resistive material has increased electrical resistance compared with an electrical resistance of the second electrically conductive material of the ground plane.

17. The system of claim 16 wherein the resistive material is positioned at locations within the perimeter of the ground plane to suppress field modes that result from the emission of the electromagnetic energy by the antenna element.

18. The system of claim 17 wherein the resistive material is positioned at the locations where maximum energy of the field modes occur.

19. The system of claim 16 wherein the resistive material comprises a plurality of concentric rings within the perimeter of the ground plane.

20. A printed circuit board antenna system comprising:

a printed circuit board stackup comprising a dielectric substrate that comprises first and second surfaces that are opposite to one another;

a first electrically conductive material of an antenna element adjacent to the first surface of the dielectric substrate, wherein the antenna element is configured to emit electromagnetic energy;

a second electrically conductive material of a ground plane adjacent to the second surface of the dielectric substrate, wherein the ground plane is aligned with the antenna element and configured to reflect some of the electromagnetic energy in a direction towards the antenna element; and wherein the antenna element is a spiral antenna element comprising a plurality of electrically conductive arms, and wherein some portions of the arms have increased electrical resistance compared with other portions of the arms.

21. A printed circuit board antenna system comprising:

a printed circuit board stackup comprising a dielectric substrate that comprises first and second surfaces that are opposite to one another;

a first electrically conductive material of an antenna element adjacent to the first surface of the dielectric substrate, wherein the antenna element is configured to emit electromagnetic energy;

a second electrically conductive material of a ground plane adjacent to the second surface of the dielectric substrate, wherein the ground plane is aligned with the antenna element and configured to reflect some of the electromagnetic energy in a direction towards the antenna element; and wherein the dielectric substrate is a first dielectric substrate, and further comprising:

a second dielectric substrate having a first surface adjacent to the ground plane; and at least one electrical conductor adjacent to a second surface of the second dielectric substrate, and wherein the at least one electrical conductor is configured to conduct electrical signals with respect to the antenna element.

22. The system of claim 21 further comprising an electrical component adjacent to the second surface of the second dielectric substrate, and wherein the electrical component is coupled with the electrical conductor.

23. An antenna system comprising:

a dielectric substrate comprising first and second surfaces that are opposite to one another;

an antenna element adjacent to the first surface of the dielectric substrate, wherein the antenna element is configured to emit electromagnetic energy;

an electrically conductive ground plane adjacent to a second surface of the dielectric substrate, wherein the ground plane has a perimeter and is configured to reflect some of the electromagnetic energy in a direction towards the antenna element; and a resistive material within the perimeter of the ground plane, and wherein the resistive material has an increased electrical resistance compared with an electrical resistance of material of the ground plane.

24. The system of claim 23 wherein the ground plane is positioned directly below the antenna element.

25. The system of claim 23 wherein the antenna element is a first antenna element and the ground plane is a first ground plane, and further comprising:

a plurality of additional antenna elements adjacent to the first surface of the dielectric substrate; and a plurality of additional ground planes adjacent to the second surface of the dielectric substrate.

26. The system of claim 25 wherein the dielectric substrate comprises at least one layer of continuous dielectric material.

27. The system of claim 25 wherein each of the additional ground planes has a perimeter, and further comprising a plurality of vias about a perimeter of each of the antenna elements and about the perimeter of each of the ground planes.

28. The system of claim 23 wherein the resistive material is positioned at a location within the perimeter of the ground plane to suppress some of the electromagnetic energy emitted from the antenna element in a direction towards the ground plane.

29. The system of claim 23 wherein the resistive material is positioned at locations within the perimeter of the ground plane to suppress field modes that result from the emission of the electromagnetic energy by the antenna element.

30. The system of claim 29 wherein the resistive material is positioned at the locations where maximum energy of the field modes occur.

31. The system of claim 23 wherein the resistive material comprises a plurality of concentric rings.

32. The system of claim 23 wherein the antenna system is unidirectional and the electromagnetic energy is emitted outwardly from the antenna system in a single direction away from the antenna system.

33. The system of claim 23 further comprising a plurality of vias about a perimeter of the antenna element and the perimeter of the ground plane, and wherein the vias comprise electrically conductive material between the first and second surfaces of the dielectric substrate.

34. The system of claim 23 wherein the dielectric substrate comprises at least one PCB layer of dielectric material.

35. The system of claim 23 wherein the antenna element and the ground plane are provided upon respective printed circuit board layers of a printed circuit board stackup.

36. An antenna system comprising:

a dielectric substrate comprising first and second surfaces that are opposite to one another;

a first electrically conductive material of a first antenna element adjacent to the first surface of the dielectric substrate, wherein the first antenna element is configured to emit electromagnetic energy;

a second electrically conductive material of a first ground plane adjacent to the second surface of the dielectric substrate, wherein the first ground plane is aligned with the first antenna element and configured to reflect some of the electromagnetic energy in a direction towards the first antenna element;

at least one additional antenna element adjacent to the first surface of the dielectric substrate; and at least one additional ground plane adjacent to the second surface of the dielectric substrate.

37. The system of claim 36 wherein the dielectric substrate comprises at least one layer of continuous dielectric material.

38. An antenna system comprising:

a dielectric substrate comprising first and second surfaces that are opposite to one another;

a first electrically conductive material of an antenna element adjacent to the first surface of the dielectric substrate, wherein the antenna element is configured to emit electromagnetic energy;

a second electrically conductive material of a ground plane adjacent to the second surface of the dielectric substrate, wherein the ground plane is aligned with the antenna element and configured to reflect some of the electromagnetic energy in a direction towards the antenna element; and a resistive material within a perimeter of the ground plane, and wherein the resistive material has increased electrical resistance compared with an electrical resistance of the second electrically conductive material of the ground plane.

39. The system of claim 38 wherein the resistive material is positioned at locations within the perimeter of the ground plane to suppress field modes that result from the emission of the electromagnetic energy by the antenna element.

40. The system of claim 39 wherein the resistive material is positioned at the locations where maximum energy of the field modes occur.

41. The system of claim 38 wherein the resistive material comprises a plurality of concentric rings within the perimeter of the ground plane.

42. An antenna system comprising:

a dielectric substrate comprising first and second surfaces that are opposite to one another;

a first electrically conductive material of an antenna element adjacent to the first surface of the dielectric substrate, wherein the antenna element is configured to emit electromagnetic energy;

a second electrically conductive material of a ground plane adjacent to the second surface of the dielectric substrate, wherein the ground plane is aligned with the antenna element and configured to reflect some of the electromagnetic energy in a direction towards the antenna element; and wherein the antenna element is a spiral antenna element comprising a plurality of electrically conductive arms, and wherein some portions of the arms have increased electrical resistance compared with other portions of the arms.

43. An antenna system comprising:

a first dielectric substrate comprising first and second surfaces that are opposite to one another;

a first electrically conductive material of an antenna element adjacent to the first surface of the first dielectric substrate, wherein the antenna element is configured to emit electromagnetic energy;

a second electrically conductive material of a ground plane adjacent to the second surface of the first dielectric substrate, wherein the ground plane is aligned with the antenna element and configured to reflect some of the electromagnetic energy in a direction towards the antenna element;

a second dielectric substrate having a first surface adjacent to the ground plane; and at least one electrical conductor adjacent to a second surface of the second dielectric substrate, and wherein the at least one electrical conductor is configured to conduct electrical signals with respect to the antenna element.

44. The system of claim 43 further comprising an electrical component adjacent to the second surface of the second dielectric substrate, and wherein the electrical component is coupled with the at least one electrical conductor.

45. A printed circuit board antenna system comprising:

a printed circuit board stackup comprising a dielectric substrate that comprises first and second surfaces that are opposite to one another;

a first electrically conductive material of an antenna element adjacent to the first surface of the dielectric substrate, wherein the antenna element is configured to emit electromagnetic energy;

a second electrically conductive material of a ground plane adjacent to the second surface of the dielectric substrate, wherein the ground plane is aligned with the antenna element and configured to reflect some of the electromagnetic energy in a direction towards the antenna element;

wherein the dielectric substrate comprises a cavity between the first and second surfaces of the dielectric substrate, and wherein the cavity is aligned with the antenna element and the ground plane; and a third electrically conductive material adjacent to and outside a perimeter of the antenna element and adjacent to and outside a perimeter of the ground plane.

* * * * *